United States Patent [19]

Small, Jr.

[11] 4,379,066

[45] Apr. 5, 1983

[54] METHOD FOR REDUCING BRAKE NOISE IN OIL-IMMERSED DISC BRAKES

[75] Inventor: Vernon R. Small, Jr., Rodeo, Calif.

[73] Assignee: Chevron Research Company, San Francisco, Calif.

[21] Appl. No.: 209,569

[22] Filed: Nov. 24, 1980

[51] Int. Cl.[3] ..... C10M 1/26

[52] U.S. Cl. ..... 252/56 R; 188/264 B; 188/264 E; 188/264 F; 252/11; 252/79

[58] Field of Search ..... 252/11, 56 R; 188/73.5, 188/264 B, 264 E, 264 F, 79 R, 79 HF

[56] References Cited

U.S. PATENT DOCUMENTS

| | | | |
|---|---|---|---|
| 1,418,695 | 6/1922 | Boileau | 252/56 R X |
| 1,573,468 | 2/1926 | Wieser | 252/56 R X |
| 2,204,601 | 6/1940 | Kavanagh et al. | 252/56 R X |
| 3,156,653 | 11/1964 | Foehr | 252/33.6 X |
| 3,429,820 | 2/1969 | Lyons et al. | 252/79 X |
| 3,626,559 | 12/1971 | Rossmann et al. | 252/56 R X |
| 3,899,432 | 8/1975 | Rothert et al. | 252/32.7 E |
| 3,949,844 | 4/1976 | Larson et al. | 188/264 E X |
| 4,061,207 | 12/1977 | Ahlen | 188/264 E |
| 4,098,951 | 7/1978 | Wolff | 252/11 X |

*Primary Examiner*—Andres Metz

*Attorney, Agent, or Firm*—D. A. Newell; J. M. Whitney; V. J. Cavalieri

[57] ABSTRACT

Lubricating oils containing oil soluble hydroxyalkyl alkanoates have been found to reduce brake noise for oil-immersed disc brakes.

5 Claims, No Drawings

METHOD FOR REDUCING BRAKE NOISE IN OIL-IMMERSED DISC BRAKES

FIELD OF THE INVENTION

This invention relates to lubricating oil compositions, particularly to lubricating oil compositions useful as functional fluids in systems requiring coupling, hydraulic fluids and/or lubrication of relatively moving parts. More particularly, it is concerned with functional fluids for use in the lubrication of heavy machinery, particularly high-power-output tractors, and to the reduction of brake chatter therein.

DESCRIPTION OF THE PRIOR ART

The use of heavy machinery, such as a tractor, has increased the demand for high-performance lubricating compositions. Modern tractors have many power-assisted components, such as power steering and power brakes. Power brakes are preferably of the disc type since they have greater braking capacity. The preferred disc brakes are the wet-type brake, which are immersed in a lubricant and are therefore isolated from dirt and grime.

Such brakes suffer from at least one problem, namely, brake chatter or brake squawk. This phenomenon is a very unpleasant noise that occurs upon application of the brake. In the past, friction-modifying agents, such as dioleylhydrogen phosphite, have been added to the brake lubricating composition to reduce the chatter. Lubricating compositions containing this additive tend to suffer from very high wear rates, particularly at high temperature.

A further complication in eliminating brake chatter is the desire to use the same functional fluid, not only for the brake lubrication, but also for lubrication of other tractor parts, such as the hydraulic and mechanical power take-offs, the tractor transmission, gears and bearings, and the like. The functional fluid must act as a lubricant, a power transfer means, and as a heat transfer medium. Obtaining a compounded fluid to meet all of these needs without brake chatter is difficult.

U.S. Pat. No. 3,649,538 discloses and claims a process for lubricating aluminum in an aluminum-shaping operation with a lubricant comprising a mineral oil and 0.1 to 30 volume % of a $C_{10}$–$C_{30}$ 1,2-diol.

SUMMARY OF THE INVENTION

It has now been found that certain oil soluble 1,2 or 2,1-hydroxyalkyl alkanoates containing from 11 to 60 carbon atoms act as appropriate friction-modifying agents, which, when added to a lubricating oil, exhibit good anti-chatter characteristics.

More specifically, this invention relates to a method for reducing brake chatter between oil-immersed disc brakes by lubricating the contacting surfaces of said brakes with a composition comprising a major amount of a lubricating oil containing an effective amount to reduce chatter of an hydroxyalkyl alkanoate of the formula:

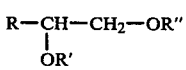

$$R-\underset{\underset{OR'}{|}}{CH}-CH_2-OR'' \quad \text{I}$$

wherein R is alkyl containing from 8 to 28 carbon atoms and one of R′ and R″ is H and the other is alkanoyl containing 1 to 30 carbon atoms or mixtures thereof.

DETAILED DESCRIPTION

The hydroxyalkyl alkanoates of the Formula I useful in the present invention are those having a total of from 11 to 60 carbon atoms, namely, from 10 to 30 carbon means in the hydroxyalkyl portion and from 1 to 30 carbon atoms in the alkanoyl portion.

Representative of the alkyl groups containing 8 to 28 carbon atoms defined by R include octyl, decyl, dodecyl, pentadecyl, eicosyl and the like. Preferably the alkyl group contains from 8 to 18 carbon atoms, and most preferably from 13 to 18 carbon atoms.

The alkanoyl groups containing 1 to 30 carbon atoms in the definition of R′ and R″ are derived from the corresponding alkanoic acids. Representative of the alkanoic acids which include both saturated and unsaturated acids and containing 1 to 30 carbon atoms from which the alkanoyl group is derived include formic acid, acetic acid, butanoic acid, hexenoic acid, octanoic acid, dedocanoic acid, oleic acid, eicosanoic acid, tricontanoic acid, and the like. Preferably the alkanoyl group is saturated and contains from 1 to 18 carbon atoms and most preferably 1 carbon atom.

Single carbon number species may be employed such as 2-hydroxydecyl octanoate, 2-hydroxyoctadecyl formate, 2-hydroxydodecyl dodecanate, 2-hydroxyeicosyl formate and 1-methyloltetradecyl formate, and the like, but a blend of several carbon numbers is preferred. Typical blends include the mixture of about equal parts of 2-hydroxydecyl formate, 2-hydroxyundecyl formate, 2-hydroxydodecyl formate, 2-hydroxytridecyl formate, 2-hydroxytetradecyl formate, 2-hydroxypentadecyl formate, 2-hydroxyhexadecyl formate, 2-hydroxyheptadecyl formate, 2-hydroxyoctadecyl formate, 2-hydroxynonadecyl formate and 2-hydroxyeicosyl formate, or a mixture of 1-methylolundecyl formate, 1-methyloltridecyl formate, and 1-methylolpentadecyl formate, or a mixture of 1-methyloltetradecyl formate, 1-methylolpentadecyl formate, 1-methylolhexadecyl formate and 1-methylolheptadecyl formate, or a mixture of 2-hydroxytetracosyl formate, 2-hydroxyhexacosyl formate, and 2-hydroxyoctacosyl formate. The corresponding acetates, octanoates, octadecanoates, oleates and the like may also be used in place of the formates.

The hydroxyalkyl alkanoates useful for this invention are readily prepared from the corresponding 1-olefin by methods well known in the art. For example, the olefin is first reacted with peracid, such as peroxyacetic acid or perbenzoic acid to form an alkane-1,2-epoxide which is readily esterified with an alkanoic acid containing 1 to 30 carbon atoms to the 2-hydroxyalkyl alkanoate. In yet another process, the olefin is first halogenated to a 1,2-dihaloalkane, then hydrolyzed to an alkane-1,2-diol by reaction first with sodium acetate and then with sodium hydroxide, or the olefin is epoxidized as described above and readily hydrolyzed under acid or basic catalysis to the alkane 1,2-diol, and finally esterified with an equal molar amount of alkanoic acid containing 1 to 30 carbon atoms to give a mixture of 2-hydroxyalkyl alkanoate and 1-methylolalkyl alkanoate. Finally, a product predominating in 1-methylolalkyl alkanoates may be made by a series of steps in which an appropriate aldehyde is first reacted with 1,3-dithiacyclopentane under basic conditions to give the mercaptal of a 2-hydroxyaldehyde, which is converted to the corresponding mercaptal-ester by reaction with an appropriate alkanoic anhydride. This material is preferentially hydrolyzed to the aldehyde ester by treatment with methyl iodide, acetonitrile and water. Reduction of the aldehyde gives the desired 1-methylolalkyl alkanoate.

1-Olefins are available from the thermal cracking of waxes. This process produces olefins of all carbon numbers. 1-Olefins, having an even number of carbon atoms, are prepared by the well-known ethylene "growth" reaction. Olefins obtained by either of these processes are essentially linear in structure with little or no branching. Linear olefins are the preferred olefins for conversion into hydroxyalkyl alkanoates of the Formula I.

The lubricating compositions used in the process of this invention contain a major amount of a lubricating oil and from about 0.2% to 5.0% by weight of the hydroxyalkyl alkanoate of the Formula I, preferably from 0.5% to 4.0%, and most preferably 1% to 2% by weight based on the weight of the total composition. The optimum amount of a hydroxyalkyl alkanoate within these ranges will vary slightly depending on the base oil and other additives present in the oil.

Additive concentrates are also included within the scope of this invention. In the concentrate additive form, the hydroxyalkyl alkanoate is present in a concentration ranging from 5% to 50% by weight.

The lubricating compositions are prepared by admixing, using conventional techniques, the appropriate amount of the desired hydroxyalkyl alkanoate with the lubricating oil. When concentrates are being prepared, the amount of hydrocarbon oil is limited, but is sufficient to dissolve the required amount of hydroxyalkyl alkanoate. Generally, the concentrate will have sufficient hydroxyalkyl alkanoate to permit subsequent dilution with 1- to 10-fold more lubricating oil.

The hydrocarbon-based lubricating oil, which may be employed in the practice of this invention, includes a wide variety of hydrocarbon oils derived from synthetic or natural sources, such as naphthenic base, paraffin base, and mixed base oils as are obtained from the refining of crude oil. Other hydrocarbon oils derived from shale oil, tar sands or coal are also useful. The lubricating oils may be used individually or in combinations wherever miscible. The lubricating oils generally have a viscosity which ranges from 50 to 5,000 SUS (Saybolt Universal Seconds), and usually from 100 to 1,500 SUS at 100° F. The preferred oils have an SAE rating in the range of 10 to 40 and are paraffinic in structure.

In some tractor systems in which the brake fluid is kept in a separate sump, the hydrocarbon oil/hydroxyalkyl alkanoate composition of this invention is a sufficient lubricant and can be used as such. However, in the more usual tractor systems in which there is a common sump for all functional fluids, e.g., transmission lubricant, hydraulic fluid, and the like, the lubricating oil is compounded with a variety of additives. These additives include anti-oxidants, dispersants, rust inhibitors, foam inhibitors, corrosion inhibitors, anti-wear agents, viscosity index (VI) improvers, friction control agents, elastomer swell agents, extreme pressure (EP) agents, pour point depressants, and metal deactivators. All of these additives are well known in the lubricating oil art.

The preferred additives are dispersants, such as the alkenyl succinimides, in particular, the polyisobutenyl succinimide of a polyethylene polyamine, e.g., tetraethylene pentamine or triethylene tetramine. Such dispersants may be present in the finished product at concentrations in the range of 0.5% to 12%, preferably 2% to 5%.

Another class of preferred additives are the hydrocarbon soluble detergents, such as the alkylphenates, the alkylbenzene sulfonates or the alkane sulfonates. These detergents are preferably present as the calcium salt in quantities ranging from 10 to 60, preferably 20 to 50, millimoles of alkyl phenol per kilogram and from 5 to 25, preferably 10 to 20, millimoles of sulfonate per kilogram of finished product. Overbased phenates and sulfonates may also be employed to prevent acid build-up. Such materials contain excess calcium, generally as calcium carbonate, over that necessary to neutralize the hydrocarbon phenols or sulfonic acid detergents. These overbased phenates and sulfonates are generally present in the finished composition in amounts of 50 to 200, preferably 75 to 150, millimoles per kilogram of product.

Furthermore, the finished lubricant preferably contains extreme pressure additives, such as the alkyl, aryl, alkaryl or aralkyl zinc dithiophosphates. Preferably, the alkyl type are employed wherein the alkyl group has from 6 to 12 carbon atoms. The total amount of the zinc dialkyldithiophosphate present is in the range of 3 to 30, preferably 15 to 25, millimoles of zinc per kilogram of finished product.

Concentrates containing the above-described additives would have a correspondingly higher concentration of the additive such that upon dilution, the final concentrations would be within the above ranges.

The compositions of this invention were tested in the laboratory and in the field on a tractor. The laboratory test was carried out on an SAE No. 2 friction machine modified by replacing the high-speed electric motor with a moderate-speed hydraulic motor. The test specimen was a sandwich of one General Metals Powder Co. sintered bronze plate between two steel spacer plates mounted in the above apparatus. The test fluid, about 300 grams in quantity, was then charged to the test-oil sump. The test plates were turned at 50 RPM. A piston-like brake was applied at an applied pressure of 75 pounds. The strain gauge of the SAE No. 2 apparatus measured the torque as a deflection of a pointer. High-brake chatter compositions gave a series of wide deflections, whereas compositions of low-brake chatter gave essentially no deflection to the pointer. Satisfactory compositions are those giving about 6 mm or less of deflection.

EXAMPLE 1

To a two-liter reaction flask is added 114 gm (0.5 mole) of a mixture comprising about equal parts by weight of $C_{15}$–$C_{18}$ alpha-olefins and 263 mls (5 moles) of 88% formic acid. The reaction mixture was heated to about 70° C. after which 226 mls of 15% $H_2O_2$ (1 mole) was added dropwise over a period of 5 hours. The reaction mixture was stirred for an additional 44 hours at about 70° C. After cooling, the organic phase was separated and diluted with an equal volume of toluene, and stripped on a roto vac. for one-half hour at 120° C. at 0.25 mm Hg. The mixture of $C_{15}$–$C_{18}$ 2-hydroxyalkyl formate obtained weighed 138.90 gms and had an hydroxyl No. of 121 mg KOH/gm.

In a similar fashion, a mixture of $C_{11}$–$C_{14}$ 2-hydroxyalkyl formates, as well as 2-hydroxydodecyl formate and 2-hydroxyoctadecyl formate are prepared by substituting the corresponding alpha-olefins for the $C_{15}$–$C_{18}$ alpha-olefins in the above Example.

EXAMPLE 2

To a 2-liter reaction flash equipped with a reflux condensor and Dean Stark collector was charged 262 gm (1 mole) of $C_{15}$–$C_{18}$ 1,2 diol, 268 gm (0.95 mole) of oleic acid, 1 gm p-toluene sulfonic acid and 500 ml xylene. The reaction mixture was heated at reflux (155° C.) with stirring for 66 hours, and 15 ml water was collected in the Dean Stark trap. The xylene was then evaporated and 517 gm of the product was collected. Infra-red analysis of the product indicated a characteristic carbonyl bond at 1740 $cm^{-1}$.

EXAMPLE 3

The above-described test was run on a non-compounded midcontinent paraffin based mineral oil (Citcon 350 N). The deflection was 17 mm, indicating a very high-brake chatter lubricant. Then sufficient 2-hydroxyalkyl formate to give a concentration of 1.5% by weight and comprising about equal weights of 2-hydroxypentadecyl formate, 2-hydroxyhexadecyl formate, 2-hydroxyheptadecyl formate and 2-hydroxyoctadecyl formate were added to this base oil. The resulting composition gave a 4-mm deflection to the torque gauge of the above apparatus, indicating low-brake chatter.

The procedure of Example 3 was repeated except that the 2-hydroxyalkyl formate additive was a mixture of about equal weights of 2-hydroxytetracosyl formate and 2-hydroxyoctacosyl formate. The torque gauge gave a deflection of 6 mm, a considerable improvement over the 17 mm deflection of the unmodified base stock.

In a similar manner, separate oil compositions containing 2% each of 1-hydroxyoctadecyl formate, 2-hydroxydodecyl formate, 2-hydroxyoctadecyl formate or a mixture of $C_{15}$–$C_{18}$ 2-hydroxyalkyl octadecanoate or a mixture of $C_{15}$–$C_{18}$ 2-hydroxyalkyl oleate are effective in reducing brake chatter.

EXAMPLE 4

In the field, a Ford tractor, Model 6600, having medium-to-heavy brake chatter (101–102 decibels), with a regular commercial compounded oil was used to test formulations containing hydroxyalkyl alkanoates of the Formula I. For these tests a base lubricating oil was compounded with the usual succinimide dispersants, sulfonate detergents, and zinc dialkyldithiophosphate. Then after testing this compounded base lubricant in the tractor, various quantities of a mixture of $C_{15}$–$C_{18}$ (incl.) hydroxyalkyl formates of Example 1 were added to the lubricant and the test repeated. The test comprised driving the tractor in high range fifth gear at 2000 RPM with alternating left and right brake applications while turning sharply. The noise level was determined by ear as none, light, medium or heavy. The results are shown in Table II.

TABLE II

Effect of Hydroxyalkyl Alkanoates on Tractor Brake Chatter

| No. | Percent Formate | SOUND LEVEL (CHATTER) LEFT | RIGHT |
|---|---|---|---|
| 1 | —(1) | Med-Hvy | Med-Hvy |
| 2 | 1.0 | Lt. Intermittent | Lt. Intermittent |

(1)Base lubricant was a mixture of 65/35% (wt.) of a paraffinic base oil of 160 N and 300 N, respectively.

These results show an improvement in tractor brake chatter obtained by the use of the hydroxyalkyl alkanoate in the brake lubricant which also contained a conventional additives package.

What is claimed is:

1. A method for reducing oil-immersed disc brake chatter by lubricating the contacting surfaces of oil-immersed disc brakes with a composition comprising a hydrocarbon-based lubricant containing an effective amount to reduce chatter of a hydroxyalkyl alkanoate of the formula:

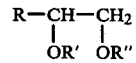

wherein R is alkyl containing from 8 to 28 carbon atoms and one of R′ and R″ is hydrogen and the other is alkanoyl containing 1 to 30 carbon atoms, or mixtures thereof.

2. The method of claim 1 wherein said lubricant contains from about 0.5% to about 5% by weight of said hydroxyalkyl alkanoate.

3. The method of claim 1 wherein said R contains from 8 to 18 carbon atoms and one of R′ and R″ contains from 1 to 18 carbon atoms.

4. The method of claim 3 wherein R is a mixture of alkyl groups containing from 13 to 18 carbon atoms.

5. The method of claim 1 wherein R is a mixture $C_{13}$–$C_{16}$ alkyl groups and and R″ is formyl or oleoyl.

* * * * *